US007341213B2

(12) United States Patent
Boast

(10) Patent No.: US 7,341,213 B2
(45) Date of Patent: Mar. 11, 2008

(54) JAW CRUSHER WITH A HYDRAULIC CYLINDER OVERLOAD ARRANGEMENT

(75) Inventor: Ian Boast, Burton on Trent (GB)

(73) Assignee: Terex Pegson Limited (GB)

( * ) Notice: Subject to any disclaimer, the term of this patent is extended or adjusted under 35 U.S.C. 154(b) by 363 days.

(21) Appl. No.: 10/511,028

(22) PCT Filed: Apr. 12, 2003

(86) PCT No.: PCT/GB03/01552

§ 371 (c)(1),
(2), (4) Date: Dec. 9, 2004

(87) PCT Pub. No.: WO03/086633

PCT Pub. Date: Oct. 23, 2003

(65) Prior Publication Data

US 2005/0082403 A1 Apr. 21, 2005

(30) Foreign Application Priority Data

Apr. 12, 2002 (GB) ..... 0208469.7
Jul. 2, 2002 (GB) ..... 0215254.4

(51) Int. Cl.
*B02C 17/14* (2006.01)

(52) U.S. Cl. ..... 241/264; 241/269

(58) Field of Classification Search ..... 241/259.1, 241/264, 269, 286, 289, 290, 291; 30/134, 30/228

See application file for complete search history.

(56) References Cited

U.S. PATENT DOCUMENTS 3,946,955 A * 3/1976 Bond ..... 241/264
3,984,058 A * 10/1976 Archer et al. ..... 241/264
4,361,289 A 11/1982 Georget et al.
4,749,132 A * 6/1988 Hagiwara et al. ..... 241/30
4,927,089 A * 5/1990 Altmayer ..... 241/264
5,725,166 A * 3/1998 Nakayama et al. ..... 241/259.1
5,857,630 A * 1/1999 Hamaguchi et al. ..... 241/259.1

FOREIGN PATENT DOCUMENTS

EP 0433500 6/1991

OTHER PUBLICATIONS

International Search Report dated Jul. 18, 2003.

* cited by examiner

*Primary Examiner*—Shelley M. Self
(74) *Attorney, Agent, or Firm*—Young Basile

(57) ABSTRACT

A jaw crusher (10) includes a fixed jaw (16) and a swing jaw (18), which define a crushing chamber (26). The swing jaw (18) is mounted for cyclic movement in the direction of the fixed jaw (16), for crushing material between the two jaws. A cross beam (42) is adjustably received in apertures (40) provided in the walls (12, 14) of the frame (11). A toggle plate (54) is operatively arranged between the rear of the swing jaw (18) and the front of the cross beam (42). An hydraulic cylinder arrangement (60) includes a pair of cylinders mounted one on either side of the frame (11) in a respective aperture (40), in operative engagement with the rear of the cross beam (42). In use, the cylinders are pressurised to a predetermined value to provide an adjustable, pre-loaded reaction against the toggle plate (54), in line with the side walls.

28 Claims, 2 Drawing Sheets

JAW CRUSHER WITH A HYDRAULIC CYLINDER OVERLOAD ARRANGEMENT

BACKGROUND OF THE INVENTION

The present invention relates to a jaw crusher, more particularly, but not exclusively, to a jaw crusher for crushing rock material.

Quarried material is often processed by means of crushing plant, for the production of aggregate, for example. There are various known forms of crushing plant for the comminution of rock material and the like, one of which is referred to as a jaw crusher.

One conventional jaw crusher consists of a frame having side walls and a pair of jaws, a fixed jaw and a swing jaw, disposed therebetween. The fixed jaw and a swing jaw each have a crushing face, the crushing faces being arranged in a spaced apart relationship to define a crushing chamber for receiving material to be crushed. The swing jaw is movable between a first position in which the crushing face of the swing jaw is inclined to the crushing face of the fixed jaw, and a second position in which the crushing face of the swing jaw is brought substantially parallel to the crushing face of the fixed jaw, at a predetermined spacing therefrom.

The upper end of the swing jaw is connected to an eccentric shaft, which is located in a rotatable bearing. In use, as the bearing is rotated, the shaft is caused to proscribe a circle, which in turn causes the upper end of the swing jaw to proscribe a circle in the direction of the fixed jaw. Hence, the crushing face of the swing jaw moves in a crush cycle between the first and second positions, up and down, as well as towards and away from the crushing face of the fixed jaw. Movement of the swing jaw in this manner causes impelling forces for crushing material present in the crushing chamber.

Typically, a jaw crusher as described above will include a toggle plate located behind the swing jaw, adjacent the lower end of the swing jaw, for supporting the lower end of the swing jaw during the crush cycle. In a known type of jaw crusher, one end of the toggle plate reacts against the rear face of the swing jaw, and the other end of the toggle plate reacts against a cross beam provided behind the swing jaw and extending between the side walls of the jaw crusher frame.

To enable a predetermined maximum product size to be produced during the crush cycle, the spacing between the pair of jaws at their lower ends, i.e. where the crushed material is discharged during the crush cycle, can be adjusted. It is known to insert or remove shim packs or other adjustment means between the toggle plate and the cross beam, thus reducing or increasing the distance between the lower ends of the two jaws. It will be understood that larger pieces of crushed material are produced using a greater jaw spacing than would be produced by using a smaller jaw spacing.

If an uncrushable object enters the crushing chamber, during the crushing cycle, substantial forces are generated as the swing jaw acts to complete its cyclic motion against the uncrushable object. The forces generated can make the removal of the uncrushable object a dangerous exercise. Moreover, the generation of these forces can cause damage to the jaw crusher. In some cases, the substantial forces generated will cause the toggle plate to yield, which renders the jaw crusher inoperative until the toggle plate is replaced, therefore effecting productivity.

GB812507 describes a jaw crusher substantially as described above which teaches a solution to these problems. In this case, the cross beam is slidably received in the side walls of the jaw crusher frame, whereby the ends of the cross beam extend outside the walls of the jaw crusher frame. The ends of the cross beam carry bearing blocks and a tie-rod is attached to each bearing block, each of which extend away from the bearing blocks in the direction of the fixed jaw. The other end the tie-rods are each secured to a crosshead located on the outside of the respective wall of the jaw crusher frame. A pair of pressure cylinders, in parallel, is mounted on either side of the jaw crusher frame, in line with the tie rods and between an associated crosshead and bearing block. Each cylinder includes a piston rod which is attached to a respective crosshead.

Under normal operating conditions, the cylinders act to push the crossheads forwards, i.e. in the direction of the fixed jaw, thereby pulling the tie-rods in a direction away from the bearing blocks. Hence, the tie-rods are put in tension, which biasses the cross beam in its slidable mounting in the direction of the fixed jaw, to bias the toggle plate against the swing jaw.

When excessive pressure is generated in the crushing chamber, for example when an uncrushable object enters the crushing chamber, forces act to move the swing jaw backwards, i.e. away from the fixed jaw, against the toggle plate, to urge the cross beam to slide backwards in the side walls. This movement acts against the biassing action of the cylinders transmitted through the tie rods and crossheads, as described above, which can cause a further build up of pressure in the crushing chamber leading to an overload situation.

However, both sides of the cylinders are in communication with an hydraulic control system, for providing an hydraulic buffer for the crossbeam and toggle plate against overload during the crushing cycle. In the event of an excessive build up of pressure during the crush cycle, the control system communicates with the cylinders to allow backwards movement of the cross beam, thus avoiding an inertial yield of the toggle plate.

The arrangement of GB812507 has the disadvantage that, since the tie rods and associated cylinders are outside the walls of the jaw crusher frame, the action of the cylinders puts the cross beam into bending, under normal operating conditions. If excessive pressures are generated during the crush cycle, as described above, the action of the toggle plate against the cross beam causes further bending stresses in the crossbeam, which significantly magnifies the bending effect of the tie rods on the cross beam. Given the immense bending stresses which are associated with an uncrushable object entering the crushing chamber, this arrangement is not considered to be satisfactorily practical or safe, and does not effectively absorb the magnitude of the generated forces.

In addition, the magnitude of the forces involved dictates that the cylinders must, in practice, be of a very large diameter, which increases the offset distance of the line of action of the cylinders from the side walls, thus increasing the bending stresses still further.

U.S. Pat. No. 4,927,089 describes a jaw crusher which teaches an alternative solution to the problems of known jaw crushers referred to above. In this case, a plurality of parallel hydraulic cylinders are provided between the cross beam and the toggle plate, in communication with an hydraulic circuit having a pressure relief device. Once a pre-determined pressure is reached in the cylinders, due to an uncrushable object being present in the crushing chamber, for example, hydraulic fluid is released from each cylinder via the relief device, which allows the swing jaw to be moved away from the fixed jaw, to enable the uncrushable object to be passed through the chamber.

However, there are problems associated with the jaw crusher of U.S. Pat. No. 4,927,089. For instance, due to the substantial pressures generated in the cylinders during the crushing process, typically from zero to a maximum pressure with every cycle of the swing jaw, seal life within the cylinders can be compromised. Furthermore, hydraulic fluid is compressible to a degree, and therefore crushing efficiency can be compromised, as the cylinders compress the fluid during the crushing cycle, for example.

It is an object of the invention to provide a jaw crusher which reduces the disadvantages referred to above.

SUMMARY OF THE INVENTION

According to the present invention, there is provided a jaw crusher comprising a frame having a fixed jaw and a swing jaw, which define a crushing chamber for receiving material to be crushed, the swing jaw being mounted for cyclic movement in the direction of the fixed jaw; a cross beam adjustably disposed in the transverse axis of the frame; a toggle plate for operative communication between a rear portion of the swing jaw and a first face of the cross beam, characterised in that an hydraulic cylinder arrangement is provided in operative communication with an opposite, second face of the cross beam, and in which, in use, the hydraulic cylinder arrangement is pressurised to a predetermined value to provide an adjustable, pre-loaded reaction against the toggle plate.

An advantage of the invention is that, during a typical crush cycle under normal operating conditions, the pressure in the hydraulic cylinders arrangement remains substantially constant with the applied toggle plate load on the cross beam, which increases the life of the seals within hydraulic cylinder arrangement.

Preferably, the predetermined value is greater than zero and may be between 300 and 500 bar.

In a preferred embodiment, the frame includes a pair of walls, between which the swing jaw and fixed jaw are disposed, and the hydraulic cylinder arrangement consists of a pair of cylinders, one cylinder being arranged on either side of the frame, with the longitudinal axis of each cylinder being in the same plane as a respective wall.

The preferred embodiment is of particular advantage, since the load from the cylinders acts in line with the walls, and therefore no substantial additional stresses are generated in the cross beam, during operation.

Preferably, an aperture is provided in each wall for movably receiving a respective end of the crossbeam, and the cylinders are each mounted in a respective aperture.

Since the cylinders are mounted in the apertures in the walls, the load from the cylinders is transferred directly on to, and in line with, the walls, which greatly reduces the stresses within the crusher frame for any given weight of structure. This enables a substantially compact design of jaw crusher, which has particular advantage for use on a mobile crusher plant. For example, the mobile chassis can be significantly narrower than is conventionally required, thus reducing the weight of the plant and increasing the movability of the plant.

Conveniently, the cylinders have an end profile adapted for complimentary abutment with the internal surface of the apertures.

Other preferred features of the claims are set out in the dependent claims.

BRIEF DESCRIPTION OF THE DRAWINGS

The invention will now be described, by way of example only, with reference to the accompanying drawings, in which.

DETAILED DESCRIPTION OF THE DRAWING

Figure 1:
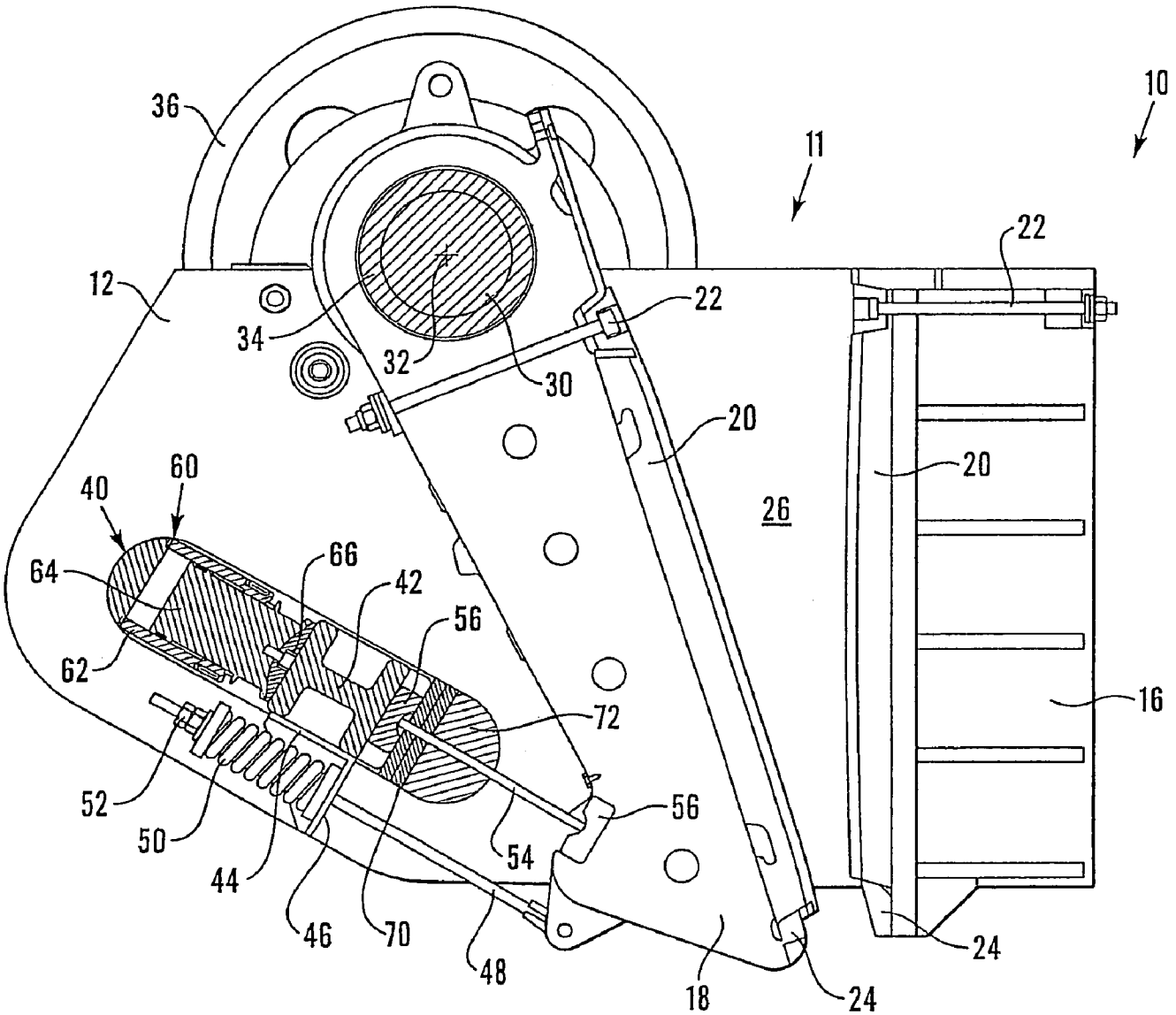
FIG. 1 is a diagrammatic view from the side of part of a jaw crusher according to the invention, showing part of the jaw crusher in cross-section.

Referring to the figures, a jaw crusher assembly is generally indicated at 10 and includes a frame 11 having a pair of opposing walls 12, 14. A pair of jaws, a fixed jaw 16 and a swing jaw 18, are supported between the walls 12, 14. The jaws 16, 18, are of conventional construction and are both provided with a wear surface 20. The upper end of the wear surfaces 20 are removably secured on a respective jaw 16, 18 by a bolt 22, and the lower end of the wear surfaces 20 engage a lip 24 provided on the lower end of a respective jaw 16, 18. The wear surfaces 20 each define a crushing face on a respective jaw 16, 18, and the two crushing faces define a crushing chamber 26 for receiving material to be crushed, for example the rock material 28 shown in FIG. 2.

The upper end of the swing jaw 18 is connected to the jaw crusher assembly 10 in a known manner by a shaft 30 having a first axis 32, which is rotatably received in a bearing 34. The portion of the shaft 30 which is received in the bearing 34, is disposed eccentrically with respect to the remainder of shaft 30 (not visible). The shaft 30 is rotatably driven by a fly wheel 36, such that rotation of the shaft 30 causes circular motion of the upper end of the swing jaw 18 in the direction of the fixed jaw 16. The mounting and movement of the upper end of the swing jaw 18 on the jaw crusher assembly 10 is wholly conventional and shall not be described in any further detail.

Figure 2:
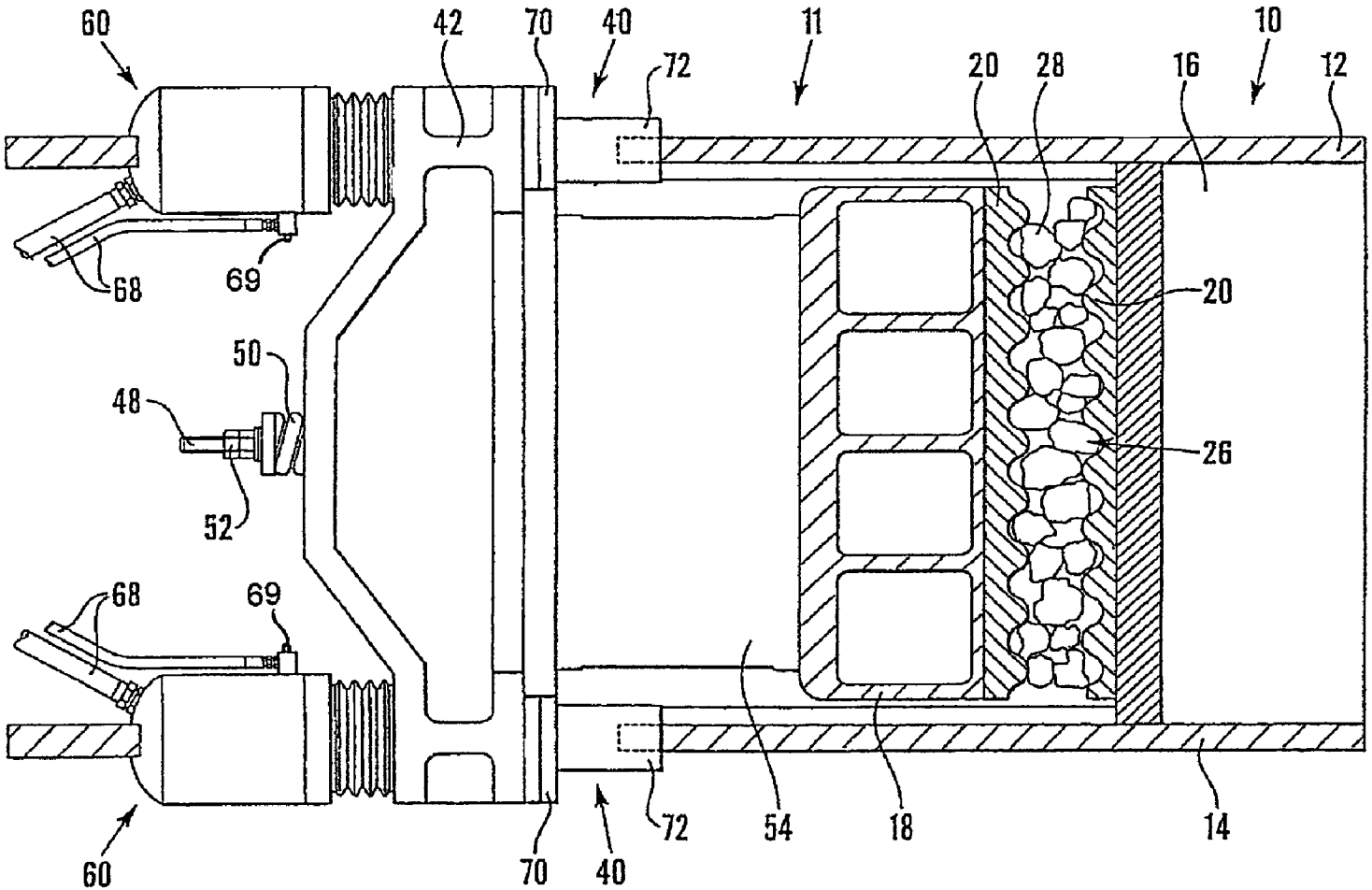
FIG. 2 is a diagrammatic cross-sectional view from above of the jaw crusher shown in FIG. 1.

The walls 12, 14 each include an elongate aperture indicated at 40, the outline of one of which is visible in FIG. 1. A cross beam 42 extends in the transverse axis of the jaw crusher assembly 10, as can be seen in FIG. 2, with the ends of the cross beam 42 being received through a respective aperture 40. A plate 44 having a flange 46 is secured to the underside of the cross beam 42, located substantially centrally with respect to the transverse axis of the jaw crusher assembly 10. A tension rod 48 extends through the flange 46, the right hand end of which, as viewed in FIG. 1, is pivotally connected to the lower end of the swing jaw 18. As can be seen, a spring 50 is provided between the free end of the tension rod 48, to the left as viewed in FIG. 1, and the flange 46. The spring 50 is secured in place by a lock nut 52 in threaded connection with the free end of the tension rod 48.

A toggle plate 54 is provided between the rear face of the swing jaw 18 and the cross beam 42, respective ends of the toggle plate 54 being movably received in a toggle seat 56 provided on each of the cross beam 42 and the swing jaw 18, for communication therewith. The toggle seats 56 have an arcuate internal profile against which the respective ends of the toggle plate 54 are in contact. The ends of the toggle plate 54 each have an arcuate profile which is shallower than that of the toggle seats 56, the toggle plate 54 thereby being able to self-centre in the toggle seats 56.

An hydraulic cylinder arrangement consisting, in this embodiment, of a pair of hydraulic cylinders 60, in parallel, is provided for operative engagement with the rear face of the cross beam 42, to the right as viewed in the Figures. Each hydraulic cylinder 60 consists of a cylinder 62 and a piston 64 which is operatively reciprocable within the cylinder 62. The pistons 64 each include an articulatable seating face 66 for engagement with the cross beam 42. The hydraulic cylinders 60 are each received in a respective aperture 40 and are provided with relief and supply lines 68 connected to an hydraulic fluid circuit (not shown). A plurality of seals are provided between the walls of each cylinder 62 and a respective piston 64 to maintain an operative chamber for the hydraulic fluid within each cylinder 60. As can be seen in FIG. 1, the closed end of the cylinders 62 have a complimentary profile to the curved ends of the apertures 40. As can be seen in FIG. 2, the cylinders are arranged with longitudinal axis of the cylinders in line with the walls 12, 14 of the frame 11, i.e. in the same plane as the walls 12, 14.

A shim pack 70, consisting of a plurality of removable shim plates, is provided in each aperture 40, in contact with the front of the cross beam 42. An insert 72 is provided in each aperture, to the right of the shim pack as viewed in the Figures, having a planar face for contact with the shim pack 72 and a curved face for complimentary engagement with the curved profile of the right hand end of the aperture 40.

In use, rotation of the shaft 30 causes cyclic movement of the swing jaw 18 between a first position, in which the crushing face of the swing jaw 18 is inclined to the crushing face of the fixed jaw 16, as shown in FIG. 1, and a second position in which the crushing face of the swing jaw 18 is brought substantially parallel to the crushing face of the fixed jaw 16, as shown in FIG. 2, at a predetermined spacing from one another. Hence, in use, the crushing face of the swing jaw 18 moves in a crushing cycle, up and down, as well as towards and away from the crushing face of the fixed jaw 16. Material to be crushed is introduced into the crushing chamber 26 through the top of the jaw crusher assembly 10 and crushed material is discharged through the spacing between the lower end of the two jaws 16, 18. The cyclic movement of the swing jaw 18, as described above, causes impelling forces for crushing the material present in the crushing chamber 26.

In the first position, in the absence of crushing material, the lower end of the swing jaw 18 is biassed by the tension rod 48 and spring 50 into a position at the predetermined spacing from the lower end of the fixed jaw 16. Further, the toggle plate 54 is clamped between the toggle seats 56, by the biassing action of the tension rod 48 and spring 50.

In use, the hydraulic cylinders 60 are pressurized to a predetermined value, for example 400 bar, against the inserts 72, through the cross beam 42 and the shim pack 70, ultimately against the right hand end of the aperture 40, as viewed in the Figures. As a crushing force is generated, during the cyclic movement of the swing jaw 18 in the direction of the fixed jaw 16, load from the crushing chamber 26 is passed through the toggle plate 54 against the cross beam 42 and on to the hydraulic cylinders 60. Hence, the hydraulic cylinders 60 provide a pre-loaded reaction to the applied load from the toggle plate 54 on the cross beam 42, against the left hand end of the aperture 40 as viewed in the Figures, which is in line with the walls 12, 14.

The benefit of this arrangement is that, during a typical crush cycle under normal operating conditions, the pressure in the hydraulic cylinders 60 remains substantially constant with the applied toggle plate load on the cross beam 42, increasing the life of the seals within each hydraulic cylinder 60. Furthermore, the load from the cylinders acts in line with the reaction points (i.e. the shim packs), and therefore no substantial additional stresses are generated in the cross beam 42. In addition, the load from the cylinders is transferred directly on to, and in line with, the crusher side walls. This greatly reduces the stresses within the crusher frame for any given weight of structure. This enables a substantially compact design of jaw crusher, which has particular advantage for use on a mobile crusher plant. For example, the mobile chassis can be significantly narrower than is conventionally required, thus reducing the weight of the plant and increasing the movability of the plant.

If an uncrushable object enters the crushing chamber 26, during the crushing cycle, substantial forces are generated as the swing jaw 18 acts to complete its cyclic motion against the uncrushable object. These forces can make the removal of the uncrushable object a dangerous exercise. Moreover, the generation of these forces can cause damage to the jaw crusher and even render the jaw crusher temporarily inoperative, therefore effecting productivity. However, the hydraulic cylinders 60 provide an adjustable reaction for the toggle plate 54 during the crush cycle.

If the pressure generated during the crushing cycle becomes excessive, for example in an overload situation where an uncrushable object is present in the crushing chamber 26, the load applied to the cross beam 42 via the toggle plate 54 will exceed the pre-loaded pressure of the hydraulic cylinders 60. A relief valve 69 is provided in the hydraulic circuit, which, when the pre-loaded value is exceeded, allows fluid under pressure to be released from the hydraulic cylinders 60. In this case, each piston 64 can be pushed backwards into a respective cylinder 62, to the left as viewed, to enable the swing jaw 18 to move away from the fixed jaw 16 and to allow the crushing chamber 26 to be cleared safely.

The spacing between the lower end of the two jaws 16, 18 is set at a predetermined distance, dependent on the size of material which is required as a result of the crushing process. It will be understood that larger pieces of crushed material are produced using a greater jaw spacing than would be produced by using a smaller jaw spacing.

To enable a predetermined maximum product size to be produced during the crush cycle, the spacing between the lower end of the pair of jaws 16, 18, i.e. where the crushed material is discharged during the crush cycle, can be adjusted by inserting or removing shim plates from the shim packs 72, thus reducing or increasing the distance between the lower ends of the pair of jaws 16, 18.

To adjust the spacing between the lower ends of the jaws 16, 18 it is first necessary to release the pressure from the cylinder arrangements 60 and to push the pistons 64 back in to the cylinders 62. The cross beam 42 is then withdrawn from the shim pack 70, to the left as viewed in the Figures, to enable shim plates to be removed or added, as required. The cylinder arrangements 60 are then pressurized to the pre-load value to bring the cross beam 42 back into contact with the shim pack 70.

The adjustability of the spacing between the jaws 16, 18 is also advantageous after a period of crushing, where components of the jaw crusher become worn, leading to an increase in the spacing between the lower ends of the jaws 16, 18. For example, the wear surfaces 20 and/or toggle seats may become worn, thus increasing the spacing between the lower ends of the jaws 16, 18. In such an instance, it will be necessary to reduce the spacing to the predetermined spacing for the required maximum crushed product size, for example by inserting shim plates.

Whilst the invention has been described with reference to the use of shim packs to provide adjustability of the spacing between the lower ends of the swing jaw and fixed jaw, it will be appreciated that other suitable adjustment means can be used, for example a plurality of wedges.

It will be understood that the jaw crusher according to the invention is suitable for the processing of quarried materials, as well as recyclable material such as construction waste, masonry and reinforced concrete.

The invention claimed is:

1. A jaw crusher for crushing material, the jaw crusher comprising: a frame having a pair of opposing walls; a fixed jaw and a swing jaw disposed between said walls, the jaws defining a crushing chamber for receiving material to be crushed, the swing jaw mounted for cyclic movement in the direction of the fixed jaw a cross beam having first and second surfaces facing in opposite directions to one another, the cross beam adjustably disposed in a transverse axis of the frame; a toggle plate mounted in operative communication between a rear portion of the swing jaw and a first face of the cross beam wherein an hydraulic cylinder arrangement is on the opposite side of the cross beam from the toggle plate, in operative communication with a second face of the cross beam, and wherein the hydraulic cylinder arrangement is pressurised to a predetermined value greater than zero, in use, to provide an adjustable, pre-loaded reaction against the toggle plate wherein the hydraulic cylinder arrangement includes two cylinders, one on either side of the frame, with the longitudinal axis of each cylinder arranged in the same plane as a respective wall, in which an aperture is provided in each wall for movably receiving a respective end of the cross beam and the cylinders are each mounted in a respective aperture.

2. A jaw crusher as claimed in claim 1, in which the cylinders have an end profile adapted for complementary abutment with the internal surface of the apertures.

3. A jaw crusher as claimed in claim 1, wherein an hydraulic circuit is provided in communication with the hydraulic cylinder arrangement, for supplying pressure to the hydraulic cylinder arrangement.

4. A jaw crusher as claimed in claim 3, wherein the hydraulic circuit includes a relief valve for releasing pressure from the hydraulic cylinder arrangement.

5. A jaw crusher as claimed claim 1, wherein means are provided for adjusting the spacing between the jaws.

6. A jaw crusher as claimed in claim 5 wherein the means for adjusting the spacing between the jaws are in the form of shim packs or wedges.

7. A jaw crusher as claimed in claim 1, wherein the hydraulic cylinder arrangement is pre-loaded against a part of the frame.

8. A jaw crusher as claimed in claim 1, wherein the frame provides a reaction to the action of hydraulic cylinder arrangement.

9. A jaw crusher as claimed in claim 1, wherein the hydraulic cylinder arrangement is in operative engagement with the second face of the cross beam.

10. A jaw crusher comprising;

a frame having a fixed jaw and a swing jaw, which define a crushing chamber for receiving material to be crushed, the swing jaw being mounted for cyclic movement in the direction of the fixed jaw;

a cross beam adjustably disposed in the transverse axis of the frame; a toggle plate for operative communication between a rear portion of the swing jaw and a first face of the cross beam;

an hydraulic cylinder arrangement provided in operative communication with an opposite, second face of the cross beam, and wherein, in use, the hydraulic cylinder arrangement is pressurized to a predetermined value to provide an adjustable, pre-loaded reaction against the toggle plate; and wherein the hydraulic cylinder arrangement comprises a first cylinder mounted in an aperture on a first side of the frame and a second cylinder mounted in an aperture on a second side of the frame.

11. A jaw crusher according to claim 10, wherein the predetermined value is between 300 and 500 bar.

12. A jaw crusher according to claim 10, wherein the frame includes a pair of opposing walls, with an aperture provided in each wall for movably receiving a respective end of the cross beam, and wherein the first and second cylinders are mounted in a respective aperture.

13. A jaw crusher according to claim 12, wherein the cylinders have an end profile adapted for complementary abutment with an internal surface of a respective aperture.

14. A jaw crusher according to claim 10, wherein an hydraulic circuit is provided in communication with the hydraulic cylinder arrangement, for supplying pressure to the hydraulic cylinder arrangement.

15. A jaw crusher according to claim 14, wherein the hydraulic circuit includes a relief valve for releasing pressure from the hydraulic cylinder arrangement.

16. A jaw crusher according to claim 10, wherein spacer means are provided for adjusting the spacing between the jaws.

17. A jaw crusher according to claim 16, wherein the spacer means are in the form of shim packs or wedges.

18. A jaw crusher according to claim 10, wherein the hydraulic cylinder arrangement is in operative engagement with the second face of the cross beam.

19. A jaw crusher for crushing material the jaw crusher comprising:

a frame having a pair of opposing walls; a fixed jaw and a swing jaw disposed between said walls, the jaws defining define a crushing chamber for receiving material to be crushed, the swing jaw mounted cyclic movement in the direction of the fixed jaw;

a cross beam having first and second surfaces facing in opposite directions to one another, the cross beam adjustably disposed in a transverse axis of the frame;

a toggle plate mounted in operative communication between a rear portion of the swing jaw and a first face of the cross beam wherein an hydraulic cylinder arrangement is on the opposite side of the cross beam from the toggle plate, in operative communication with a second face of the cross beam, and wherein the hydraulic cylinder arrangement is pressurized to a predetermined value to provide an adjustable, pre-loaded reaction against the toggle plate wherein the hydraulic cylinder arrangement includes two cylinders, one on either side of the frame, with the longitudinal axis of each cylinder arranged in the same plane as a respective wall; and wherein an aperture is provide in each wall for movably receiving a respective end of the crossbeam, and the cylinders are each mounted in a respective aperture.

20. A jaw crusher as claimed in claim 19, in which the predetermined value is between 300 and 500 bar.

21. A jaw crusher is claimed in claim 19, in which the cylinders have an end profile adapted for complementary abutment with the internal surface of the aperture.

22. A jaw crusher as claimed in claim 19, wherein an a hydraulic circuit is provided in communication with the hydraulic cylinder arrangement, for supplying pressure to the hydraulic cylinder arrangement.

23. A jaw crusher as claimed in claim 22, wherein the hydraulic circuit includes a relieve valve for releasing pressure from the hydraulic cylinder arrangement.

24. A jaw crusher as claimed in claim 19, wherein shim packs or wedges are provided for adjusting the spacing between the jaws.

25. A jaw crusher as claimed in claim 19, wherein the hydraulic cylinder arrangement is pre-loaded against a part of the frame.

26. A jaw crusher as claimed in claim 19, wherein the frame provides a reaction to the action of hydraulic cylinder arrangement.

27. A jaw crusher as claimed in claim 19, wherein the hydraulic cylinder arrangement is in operative engagement with the second face of the cross beam.

28. A jaw crusher as claimed in claim 1, in which the predetermined value is between 300 and 500 bar.

* * * * *